US011465191B2

(12) United States Patent
Saika et al.

(10) Patent No.: US 11,465,191 B2
(45) Date of Patent: Oct. 11, 2022

(54) FORMING DEVICE

(71) Applicant: SUMITOMO HEAVY INDUSTRIES, LTD., Tokyo (JP)

(72) Inventors: Masayuki Saika, Ehime (JP); Hiroyuki Kan, Ehime (JP); Kei Yamauchi, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 4 days.

(21) Appl. No.: 17/009,397

(22) Filed: Sep. 1, 2020

(65) Prior Publication Data

US 2020/0398329 A1 Dec. 24, 2020

Related U.S. Application Data

(63) Continuation of application No. PCT/JP2018/045925, filed on Dec. 13, 2018.

(30) Foreign Application Priority Data

Mar. 28, 2018 (JP) ..... JP2018-062663

(51) Int. Cl.
*B21D 26/033* (2011.01)
*B21D 37/16* (2006.01)

(52) U.S. Cl.
CPC ..... *B21D 26/033* (2013.01); *B21D 37/16* (2013.01)

(58) Field of Classification Search
CPC .... B21D 26/033; B21D 37/16; B21D 26/047; B21D 26/00; B21D 26/041
See application file for complete search history.

(56) References Cited

U.S. PATENT DOCUMENTS

| | | | | |
|---|---|---|---|---|
| 1,501,023 | A | 7/1924 | Goodspeed | |
| 6,128,936 | A * | 10/2000 | Yogo | B21D 26/041 72/58 |
| 10,173,254 | B2 | 1/2019 | Ueno et al. | |
| 2017/0095854 | A1* | 4/2017 | Ishizuka | B21D 26/025 |
| 2018/0015519 | A1* | 1/2018 | Saika | B21D 26/033 |

(Continued)

FOREIGN PATENT DOCUMENTS

| | | | |
|---|---|---|---|
| CN | 204470409 U | * | 7/2015 |
| CN | 107199270 A | | 9/2017 |
| EP | 3159071 A1 | | 4/2017 |

(Continued)

OTHER PUBLICATIONS

Search Report issued in European Application No. 18912380.5, dated Apr. 20, 2021.

(Continued)

*Primary Examiner* — Adam J Eiseman
*Assistant Examiner* — P Derek Pressley
(74) *Attorney, Agent, or Firm* — Michael Best & Friedrich LLP

(57) ABSTRACT

Provided is a forming device including a die, a lower base portion, an upper base portion, a pillar portion, and an electrical heating unit, in which, at a time of electrical heating performed by the electrical heating unit, a magnetic flux density inside the pillar portion is higher than at least one of a magnetic flux density at a center of a lower surface of the lower base portion and a magnetic flux density at a center of an upper surface of the upper base portion.

17 Claims, 6 Drawing Sheets

(56) References Cited

U.S. PATENT DOCUMENTS

2018/0221933 A1* 8/2018 Saika ..... B21D 26/033

FOREIGN PATENT DOCUMENTS

| | | | | | |
|---|---|---|---|---|---|
| JP | 2002-096118 | A | | 4/2002 | |
| JP | 2015084307 | A | * | 4/2015 | |
| JP | 2015-112608 | A | | 6/2015 | |
| KR | 2004-0087765 | A | | 10/2004 | |
| WO | WO-2015194660 | A1 | * | 12/2015 | ..... B21C 37/154 |
| WO | WO-2016158778 | A1 | * | 10/2016 | ..... B21D 26/033 |
| WO | WO-2017/038692 | A1 | | 3/2017 | |
| WO | WO-2017038692 | A1 | * | 3/2017 | ..... B21D 26/033 |

OTHER PUBLICATIONS

International Search Report issued in Application No. PCT/JP2018/045925, dated Mar. 5, 2019.

* cited by examiner

FORMING DEVICE

RELATED APPLICATIONS

The contents of Japanese Patent Application No. 2018-062663, and of International Patent Application No. PCT/JP2018/045925, on the basis of each of which priority benefits are claimed in an accompanying application data sheet, are in their entirety incorporated herein by reference.

BACKGROUND

Technical Field

Certain embodiment of the present invention relates to a forming device.

Description of Related Art

In the related art, there is known a forming device in which a metal pipe is blow-formed with a die closed. For example, a forming device described in the related art, includes a die and an electrical heating unit which electrically heats a metal pipe material. In the forming device, the metal pipe material is electrically heated and disposed in the die. In addition, in the forming device, a gas is supplied into the metal pipe material with the die being in a closed state such that the metal pipe material is expanded and is formed into a shape corresponding to the shape of the die. In the forming device of the related art, energization is performed with each electrode being in contact with the metal pipe material such that the metal pipe material is heated. In the case of electrical heating, a large current (for example, about tens of thousands of amperes) flows through a power supply line. Therefore, there is a case where the die may be moved by being magnetized due to the influence of a leakage field from the power supply line. The forming device described in the related art includes a die movement suppressing portion for suppressing the movement of the die.

SUMMARY

According to an embodiment of the present invention, there is provided a forming device which expands a metal pipe material to form a metal pipe, the forming device including a die in which the metal pipe is formed by an upper die and a lower die, a lower base portion which is provided below the lower die, an upper base portion which is provided above the upper die, a pillar portion that is provided to stand between the lower base portion and the upper base portion, and an electrical heating unit which performs electrical heating by supplying power to the metal pipe material disposed between the upper die and the lower die, in which, at a time of electrical heating performed by the electrical heating unit, a magnetic flux density inside the pillar portion is higher than at least one of a magnetic flux density at a center of a lower surface of the lower base portion and a magnetic flux density at a center of an upper surface of the upper base portion.

BRIEF DESCRIPTION OF THE DRAWINGS

FIG. 3A is a view showing a state where the electrode holds a metal pipe material, FIG. 3B is a view showing a state where a seal member is pressed against the electrode, and FIG. 3C is a front view of the electrode.

DETAILED DESCRIPTION

Figure 1:
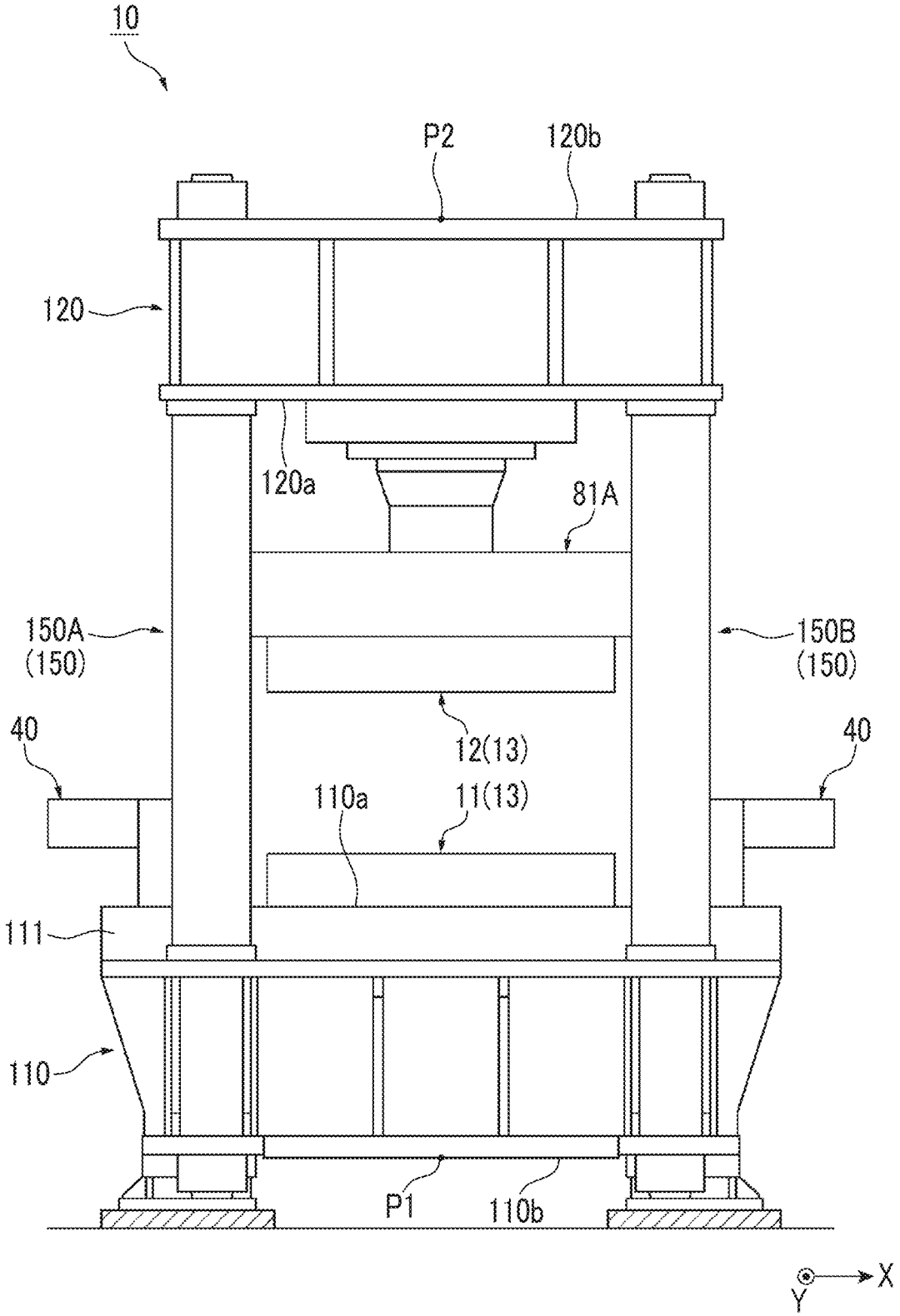
FIG. 1 is a front view of a forming device according to an embodiment of the present invention.

However, in the case of such a forming device, it is desirable to not only to suppress the movement of a die caused by magnetization accompanied by electrical heating but also to reduce the influence of a magnetic field with respect to a sensor or the like disposed near the die. That is, it is desirable to reduce the influence of a magnetic field with respect to the sensor or the like near the die.

Therefore, there is a need for providing a forming device with which it is possible to reduce the influence of a magnetic field with respect to a sensor or the like near a die.

According to the forming device, the pillar portion is disposed between the lower base portion provided below the lower die and the upper base portion provided above the upper die. In addition, at the time of electrical heating performed by the electrical heating unit, the magnetic flux density inside the pillar portion is higher than at least one of the magnetic flux density at the center of the lower surface of the lower base portion and the magnetic flux density at the center of the upper surface of the upper base portion. The magnetic flux density high at the time of electrical heating means that the pillar portion is configured to absorb a nearby magnetic flux near the die. As described above, the pillar portion absorbs a magnetic flux generated near the die and thus it is possible to reduce a magnetic flux toward another sensor by an amount corresponding to the absorption. Accordingly, it is possible to reduce the influence of a magnetic field on a sensor or the like near the die.

The forming device may further include a sensor disposed inside at least one of the upper base portion and the lower base portion. The insides of the upper base portion and the lower base portion are positions that are less likely to be influenced by a magnetic field. Therefore, with the sensor disposed at the position, it is possible to reduce the influence of a magnetic field with respect to the sensor.

In the forming device, the electrical heating unit may include a pair of electrodes which comes into contact with the metal pipe material at the time of electrical heating and a pair of busbars which transmits power to the pair of electrodes, and the pair of busbars may be disposed on one side of the die in a second direction which is orthogonal to a first direction in which the pair of electrodes is disposed such that the electrodes face each other and a vertical direction. A large current flows at the pair of the busbars at the time of electrical heating. With both of the busbars disposed on the one side of the die in the second direction, a region on the other side of the die becomes a region where a magnetic field generated from the busbars blocked by the die. Therefore, with the sensor or the like disposed on the region, it is possible to reduce the influence of a magnetic field.

Hereinafter, preferred embodiments of a forming system according to the present invention will be described with reference to the drawings. In addition, in each drawing, the same reference numerals are assigned to the same portions or the corresponding portions, and repeated descriptions thereof are omitted.

Configuration of Forming Device

FIG. 1 is a front view of a forming device according to the present embodiment. As shown in FIG. 1, the forming device 10 includes a die 13, a lower base portion 110, an upper base portion 120, and pillar portions 150. The die 13 includes an upper die 12 and a lower die 11. The lower base portion 110 faces the lower die 11 and is provided on a lower side. Note that, one direction in a horizontal direction will be referred to as an X-axis direction (first direction) and a direction orthogonal to the X-axis direction in the horizontal direction will be referred to as a Y-axis direction (second direction). One side (a right side of a paper surface in FIG. 1) in the X-axis direction will be referred to as a positive side and one side (a front side of the paper surface in FIG. 1) in the Y-axis direction will be referred to as a positive side.

The lower base portion 110 is a component called a bed and constitutes a base of the forming device 10. In the lower base portion 110, a drive mechanism or the like which moves the lower die 11 is accommodated. The lower base portion 110 has a rectangular parallelepiped shape and includes an upper surface 110*a* and a lower surface 110*b* which extend in the horizontal direction. The lower base portion 110 includes a plate-shaped base stage 111 on an upper end side. On the base stage 111, the lower die 11, electrodes which will be described later, a gas supply mechanism, and the like are disposed. An upper surface of the base stage 111 corresponds to the upper surface 110*a* of the lower base portion 110. The upper base portion 120 faces the upper die 12 and is provided on an upper side. The upper base portion 120 is a component called a crown and is a component which serves as a base for an upper structure of the forming device 10. In the upper base portion 120, a drive mechanism or the like which moves the upper die 12 is accommodated. The upper base portion 120 has a rectangular parallelepiped shape and includes a lower surface 120*a* and an upper surface 120*b* which extend in the horizontal direction. The pillar portions 150 are members provided to stand between the lower base portion 110 and the upper base portion 120. A plurality of (here, four) the pillar portions 150 are formed to surround the periphery of the die 13. Note that, the configuration of the pillar portions 150 will be described later in detail.

Figure 2:
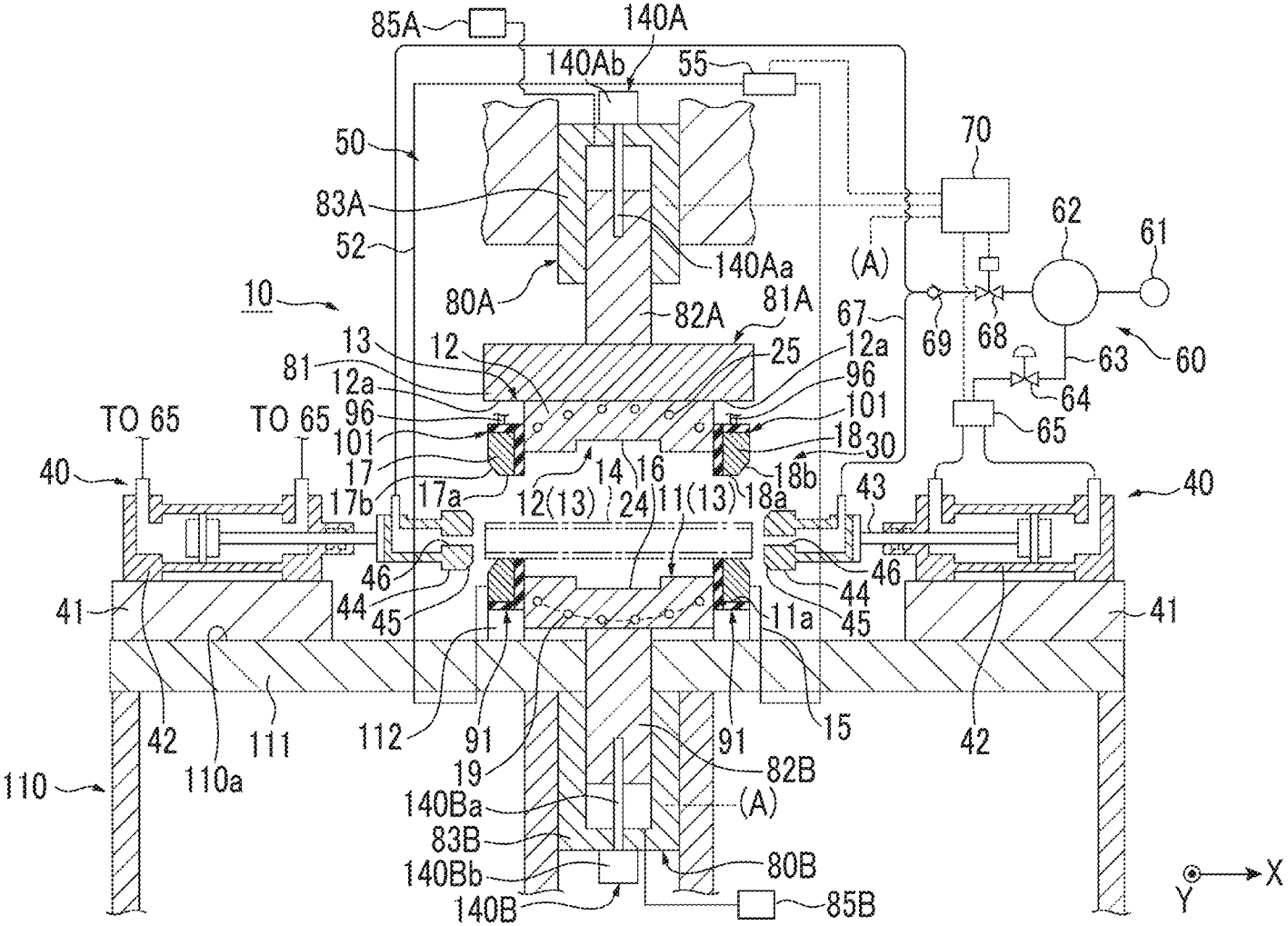
FIG. 2 is a schematic configuration view showing the forming device according to the embodiment of the present invention.

FIG. 2 is a schematic configuration view of a forming device according to the present embodiment. As shown in FIG. 1, a forming device 10 for forming a metal pipe includes the die 13 including the upper die 12 and the lower die 11, a drive mechanism 80A which moves the upper die 12, a drive mechanism 80B which moves the lower die 11, a pipe holding mechanism 30 which holds a metal pipe material 14 disposed between the upper die 12 and the lower die 11, an electrical heating unit 50 which energizes the metal pipe material 14 held by the pipe holding mechanism 30 to heat the metal pipe material 14, a gas supply unit 60 which supplies a high-pressure gas (a gas) into the metal pipe material 14 which is held between the upper die 12 and the lower die 11 and is heated, a pair of gas supply mechanisms 40 and 40 for supplying the gas from the gas supply unit 60 into the metal pipe material 14 held by the pipe holding mechanism 30, and the forming device 10 is configured to include a controller 70 which controls driving of the drive mechanisms 80A and 80B, driving of the pipe holding mechanism 30, driving of the electrical heating unit 50, and gas supply of the gas supply unit 60.

The lower die 11, which is one part of the die 13, is composed of a large steel block and includes a rectangular cavity (a recessed portion) 16 on an upper surface of the lower die 11, for example. The lower die 11 is disposed near the center of the base stage 111 of the lower base portion 110 to be movable. The lower die 11 has a rectangular parallelepiped shape extending along the X-axis direction. That is, at the time of formation, the metal pipe material 14 is formed in a state of extending along the X-axis direction. A cooling water passage 19 is formed in the lower die 11.

Furthermore, electrodes 17 and 18 (lower electrodes) and the like, which will be described later and constitute the pipe holding mechanism 30, are disposed near end portions of the lower die 11 in the X-axis direction. In addition, the metal pipe material 14 is placed on the lower electrodes 17 and 18 and the lower electrodes 17 and 18 come into contact with the metal pipe material 14 disposed between the upper die 12 and the lower die 11. As a result, the lower electrodes 17 and 18 are electrically connected to the metal pipe material 14. In the present embodiment, the lower electrodes 17 and 18 disposed in a state of being fixed to the base stage 111 at positions adjacent to both ends of the lower die 11 in the X-axis direction.

Insulating materials 91 for preventing energization are provided between the lower die 11 and the lower electrode 17, under the lower electrode 17, between the lower die 11 and the lower electrode 18, and under the lower electrode 18. Here, the lower electrodes 17 and 18 are supported by a support member 112 provided on the base stage 111 with the insulating materials 91 interposed therebetween.

The upper die 12, which is the other part of the die 13, is fixed to a slide 81A (which will be described later) constituting the drive mechanism 80A. The upper die 12 is composed of a large steel block, a cooling water passage 25 is formed in the upper die 12, and the upper die 12 includes a rectangular cavity (a recessed portion) 24 on a lower surface of the upper die 12, for example. The cavity 24 is provided at a position facing the cavity 16 of the lower die 11. The upper die 12 has a rectangular parallelepiped shape extending along the X-axis direction.

Spaces 12*a* are provided near both ends of the upper die 12 in the X-axis direction and the electrodes 17 and 18 (upper electrodes or like), which are movable portions of the pipe holding mechanism 30 and will be described later, are disposed in the spaces 12*a* to be movable forward or rearward vertically. In addition, in a state where the metal pipe material 14 is placed on the lower electrodes 17 and 18, the upper electrodes 17 and 18 come into contact with the metal pipe material 14 disposed between the upper die 12 and the lower die 11. As a result, the upper electrodes 17 and 18 are electrically connected to the metal pipe material 14.

Insulating materials 101 for preventing energization are provided between the upper die 12 and the upper electrode 17, on the upper electrode 17, between the upper die 12 and the upper electrode 18, and on the upper electrode 18. Each insulating material 101 is fixed to an advancing and retreating rod 96, which is a movable portion of an actuator constituting the pipe holding mechanism 30. The actuator is for moving the upper electrodes 17 and 18 or the like upward or downward and a fixed portion of the actuator is held on the slide 81 side of the drive mechanism 80 together with the upper die 12.

At a right part of the pipe holding mechanism 30, a semi-arc-shaped concave groove 18*a* corresponding to an outer peripheral surface of the metal pipe material 14 is formed (refer to FIGS. 3A to 3C) on each of surfaces of the electrodes 18 and 18 that face each other and the metal pipe material 14 can be placed so as to be exactly fitted into portions of the concave grooves 18*a*. At the right part of the pipe holding mechanism 30, as with the concave grooves 18*a*, a semi-arc-shaped concave groove corresponding to the outer peripheral surface of the metal pipe material 14 is formed on each of exposed surfaces of the insulating materials 91 and 101 that face each other. In addition, front surfaces (surfaces facing the outside of the die) of the electrodes 18 are formed with tapered concave surfaces 18*b* which are recessed with peripheries thereof inclined to form a shape tapered toward the concave grooves 18*a*. Accordingly, if the metal pipe material 14 is clamped from above and below at the right part of the pipe holding mechanism 30, the electrodes 18 can exactly surround the outer periphery of a right end portion of the metal pipe material 14 so as to come into close contact with the entire circumference of the right end portion of the metal pipe material 14.

At a left part of the pipe holding mechanism 30, a semi-arc-shaped concave groove 17*a* corresponding to the outer peripheral surface of the metal pipe material 14 is formed (refer to FIGS. 3A to 3C) on each of surfaces of the electrodes 17 and 17 that face each other and the metal pipe material 14 can be placed so as to be exactly fitted into portions of the concave grooves 17*a*. At the left part of the pipe holding mechanism 30, as with the concave grooves 17*a*, a semi-arc-shaped concave groove corresponding to the outer peripheral surface of the metal pipe material 14 is formed on each of exposed surfaces of the insulating materials 91 and 101 that face each other. In addition, front surfaces (surfaces facing the outside of the die) of the electrodes 17 are formed with tapered concave surfaces 17*b* which are recessed with peripheries thereof inclined to form a shape tapered toward the concave grooves 17*a*. Accordingly, if the metal pipe material 14 is clamped from above and below at the left part of the pipe holding mechanism 30, the electrodes 17 can exactly surround the outer periphery of a left end portion of the metal pipe material 14 so as to come into close contact with the entire circumference of the left end portion of the metal pipe material 14.

As shown in FIG. 2, the drive mechanism 80A includes the slide 81A which moves the upper die 12 such that the upper die 12 and the lower die 11 are joined to each other, a shaft portion 82A which is connected to the slide 81A, and a cylinder portion 83A which guides the shaft portion 82A. The cylinder portion 83A is a cylindrical member that extends in a vertical direction and is open at a lower side. At least an upper end portion of the cylinder portion 83A is disposed in the upper base portion 120. Here, the cylinder portion 83A is disposed in the upper base portion 120 over approximately the entire length and only a portion of a lower end side thereof protrudes from the upper base portion 120. The shaft portion 82A extends downward from a lower opening of the cylinder portion 83A and is connected to the slide 81A. With the shaft portion 82A reciprocating in the vertical direction while being guided by the cylinder portion 83A, the slide 81A and the upper die 12 reciprocate in the vertical direction. The shaft portion 82A is driven by a driving force such as hydraulic pressure transmitted from a drive source 85A.

The drive mechanism 80B includes the shaft portion 82B which moves the lower die 11 such that the upper die 12 and the lower die 11 are joined to each other and a cylinder portion 83B which guides the shaft portion 82B. The cylinder portion 83B is a cylindrical member that extends in a vertical direction and is open at an upper side. The cylinder portion 83B is disposed in the lower base portion 110. The cylinder portion 83B is disposed below the base stage 111 and the entire cylinder portion 83B is disposed in the lower base portion 110. The shaft portion 82B extends upward from an upper opening of the cylinder portion 83B and is connected to the lower die 11. With the shaft portion 82B reciprocating in the vertical direction while being guided by the cylinder portion 83B, the lower die 11 reciprocates in the vertical direction. The shaft portion 82B is driven by a driving force such as hydraulic pressure transmitted from a drive source 85B.

The electrical heating unit 50 includes a power supply unit 55, a power supply line 52 which electrically connects the power supply unit 55 and the electrodes 17 and 18 to each other, and the electrodes 17 and 18. The power supply unit 55 includes a DC power source and a switch and can energize the metal pipe material 14 via the power supply line 52 and the electrodes 17 and 18 in a state where the electrodes 17 and 18 are electrically connected to the metal pipe material 14. Note that, here, the power supply line 52 is connected to the lower electrodes 17 and 18.

In the electrical heating unit 50, a DC current output from the power supply unit 55 is transmitted via the power supply line 52 and input to the electrodes 17. Then, the DC current passes through the metal pipe material 14 and is input to the electrodes 18. Then, a DC current is transmitted via the power supply line 52 and input to the power supply unit 55.

Figure 3A:
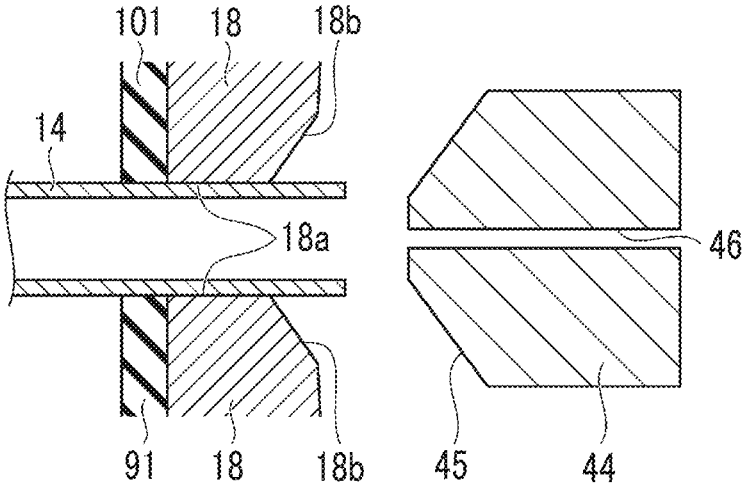
FIGS. 3A to 3C are enlarged views of a periphery of an electrode.
Figure 3B:
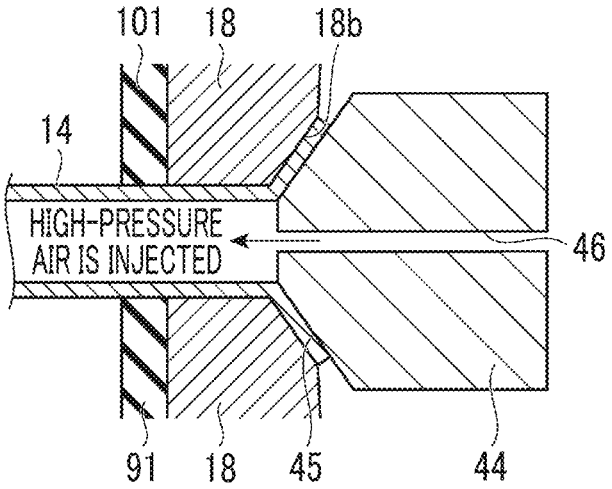
Figure 3C:
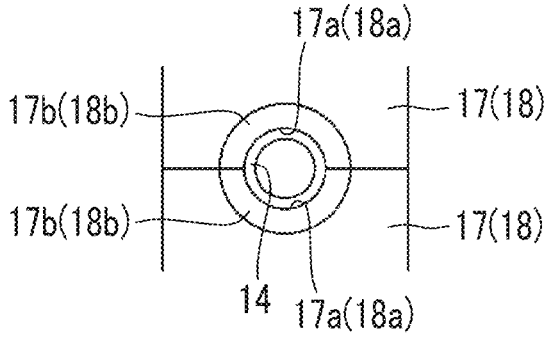

Each of the pair of gas supply mechanisms 40 includes a cylinder unit 42, a cylinder rod 43 which moves forward and rearward in accordance with an operation of the cylinder unit 42, and a seal member 44 connected to a tip of the cylinder rod 43 on the pipe holding mechanism 30 side. The cylinder unit 42 is placed on and fixed to base stage 111. At a tip of each seal member 44, a tapered surface 45 is formed to be tapered and the tip is configured to have a shape matching the tapered concave surfaces 17*b* and 18*b* of the electrodes 17 and 18 (refer to FIGS. 3A to 3C). Each seal member 44 is provided with a gas passage 46 which extends toward the tip from the cylinder unit 42 side. More specifically, as shown in FIGS. 3A and 3B, a high-pressure gas supplied form the gas supply unit 60 flows through the gas passage 46.

The gas supply unit 60 includes a gas source 61, an accumulator 62 in which the gas supplied by the gas source 61 is stored, a first tube 63 which extends from the accumulator 62 to the cylinder unit 42 of the gas supply mechanism 40, a pressure control valve 64 and a switching valve 65 which are interposed in the first tube 63, a second tube 67 which extends from the accumulator 62 to the gas passage 46 formed in the seal member 44, and a pressure control valve 68 and a check valve 69 which are interposed in the second tube 67. The pressure control valve 64 plays a role of supplying gas of an operation pressure adapted to a pressing force of the seal member 44 with respect to the metal pipe material 14 to the cylinder unit 42. The check valve 69 plays a role of preventing a high-pressure gas from back-flowing in the second tube 67. The pressure control valve 68 interposed in the second tube 67 plays a role of supplying a gas of an operation pressure for expanding the metal pipe material 14 to the gas passage 46 of the seal member 44 by being controlled by the controller 70. The pair of gas supply mechanisms 40 is disposed to face each other in the X-axis direction such that the lower die 11 is interposed therebetween.

The controller 70 can control the pressure control valve 68 of the gas supply unit 60 such that a gas of a desired operation pressure is supplied into the metal pipe material 14. In addition, the controller 70 controls the drive mechanisms 80A and 80B, the power supply unit 55, and the like.

Forming Method of Metal Pipe Using Forming Device

Next, a forming method of the metal pipe using the forming device 10 will be described. First, the quenchable steel type cylindrical metal pipe material 14 is prepared. For example, the metal pipe material 14 is placed on (inserted) the electrodes 17 and 18 provided on the lower die 11 side by means of a robot arm or the like. Since the concave grooves 17*a* and 18*a* are formed on the electrodes 17 and 18, the metal pipe material 14 is located by the concave grooves 17*a* and 18*a*.

Next, the controller 70 controls the drive mechanism 80A and the pipe holding mechanism 30 such that the metal pipe material 14 is held by the pipe holding mechanism 30. Specifically, the drive mechanism 80A is driven such that the upper die 12 held on the slide 81A side and the upper electrodes 17 and 18 are moved to the lower die 11 side and the actuator that can move the upper electrodes 17 and 18 or the like included in the pipe holding mechanism 30 forward and rearward is operated such that peripheries of the both end portions of the metal pipe material 14 are clamped from above and below by the pipe holding mechanism 30. The clamping is performed in an aspect in which the concave grooves 17*a* and 18*a* formed on the electrodes 17 and 18 and the concave grooves formed on the insulating materials 91 and 101 are provided such that the electrodes 17 and 18 come into close contact with the vicinity of each of the both end portions of the metal pipe material 14 over the entire circumference.

Note that, at this time, as shown in FIG. 3A, an end portion of the metal pipe material 14 that is on the electrode 18 side protrudes toward the seal member 44 side beyond a boundary between the concave grooves 18*a* of the electrodes 18 and the tapered concave surfaces 18*b* in a direction in which the metal pipe material 14 extends. Similarly, an end portion of the metal pipe material 14 that is on the electrode 17 side protrudes toward the seal member 44 side beyond a boundary between the concave grooves 17*a* of the electrodes 17 and the tapered concave surfaces 17*b* in the direction in which the metal pipe material 14 extends. In addition, lower surfaces of the upper electrodes 17 and 18 and upper surfaces of the lower electrodes 17 and 18 are in contact with each other. However, the present invention is not limited to a configuration in which the electrodes 17 and 18 come into close contact with the entire circumferences of the both end portions of the metal pipe material 14. That is, the electrodes 17 and 18 may abut against a portion of the metal pipe material 14 in a circumferential direction.

Next, the controller 70 controls the electrical heating unit 50 so as to heat the metal pipe material 14. Specifically, the controller 70 controls the power supply unit 55 of the electrical heating unit 50 such that power is supplied. As a result, power transmitted to the lower electrodes 17 and 18 via the power supply line 52 is supplied to the upper electrodes 17 and 18 clamping the metal pipe material 14 and the metal pipe material 14 and the metal pipe material 14 generates heat due to Joule heat caused by the resistance of the metal pipe material 14. That is, the metal pipe material 14 enters an electrically heated state.

Next, the controller 70 controls the drive mechanisms 80A and 80B such that the die 13 is closed with respect to the heated metal pipe material 14. Accordingly, the cavity 16 of the lower die 11 and the cavity 24 of the upper die 12 are combined with each other such that the metal pipe material 14 is disposed in a cavity portion between the lower die 11 and the upper die 12 and is sealed.

Thereafter, the cylinder unit 42 of the gas supply mechanism 40 is operated such that both ends of the metal pipe material 14 are sealed with the seal members 44 moving forward. At this time, as shown in FIG. 3B, the seal member 44 is pressed against the end portion of the metal pipe material 14 that is on the electrode 18 side and thus a portion of the metal pipe material 14 that protrudes toward the seal member 44 side beyond the boundary between the concave grooves 18*a* of the electrodes 18 and the tapered concave surfaces 18*b* is deformed into a funnel shape to match the tapered concave surfaces 18*b*. Similarly, the seal member 44 is pressed against the end portion of the metal pipe material 14 that is on the electrode 17 side and thus a portion of the metal pipe material 14 that protrudes toward the seal member 44 side beyond the boundary between the concave grooves 17*a* of the electrodes 17 and the tapered concave surfaces 17*b* is deformed into a funnel shape to match the tapered concave surfaces 17*b*. After the sealing is finished, a high-pressure gas is blown into the metal pipe material 14 and the heated and softened metal pipe material 14 is formed in accordance with the shape of the cavity portion.

The metal pipe material 14 is heated to a high temperature (approximately 950° C.) and softened and thus the gas supplied into the metal pipe material 14 thermally expands. Accordingly, for example, compressed air may be used as the gas to be supplied such that the metal pipe material 14 of 950° C. is easily expanded by compressed air thermally expanded.

An outer peripheral surface of the blow-formed and expanded metal pipe material 14 comes into contact with the cavity 16 of the lower die 11 so as to be rapidly cooled and comes into contact with the cavity 24 of the upper die 12 so as to be rapidly cooled (the upper die 12 and the lower die 11 have a large heat capacity and are controlled to a low temperature, and thus, if the metal pipe material 14 comes into contact with the upper die 12 and the lower die 11, a heat of a pipe surface is taken to the die side at once) at the same time so that quenching is performed. The above-described cooling method is referred to as die contact cooling or die cooling. Immediately after being rapidly cooled, austenite transforms into martensite (hereinafter, transformation from austenite to martensite is referred to as martensitic transformation). The cooling rate is made low in a second half of the cooling, and thus, martensite transforms into another structure (such as troostite, sorbite, or the like) due to recuperation. Therefore, it is not necessary to separately perform tempering treatment. In addition, in the present embodiment, the cooling may be performed by supplying a cooling medium into, for example, the cavity 24, instead of or in addition to the cooling of the die. For example, cooling may be performed by bring the metal pipe material 14 into contact with the dies (the upper die 12 and the lower die 11) until a temperature at which the martensitic transformation starts is reached and the dies may be opened thereafter with a cooling medium (cooling gas) blown onto the metal pipe material 14 such that martensitic transformation occurs.

A metal pipe having an approximately rectangular main body portion is obtained when cooling is performed and dies are opened after blow forming is performed with respect to the metal pipe material 14 as described above, for example.

Structure Related to Magnetic Field in Forming Device

In the forming device 10, the metal pipe material 14 is electrically heated. At this time, a high current is caused to flow to energization portions such as the power supply line 52 and the electrodes 17 and 18 and thus a magnetic field is formed in the vicinity thereof. Therefore, at the time of electrical heating, a magnetic flux density inside a member in the vicinities of the energization portions becomes large.

A structure related to a magnetic field generated in the forming device 10 will be described.

Figure 4:
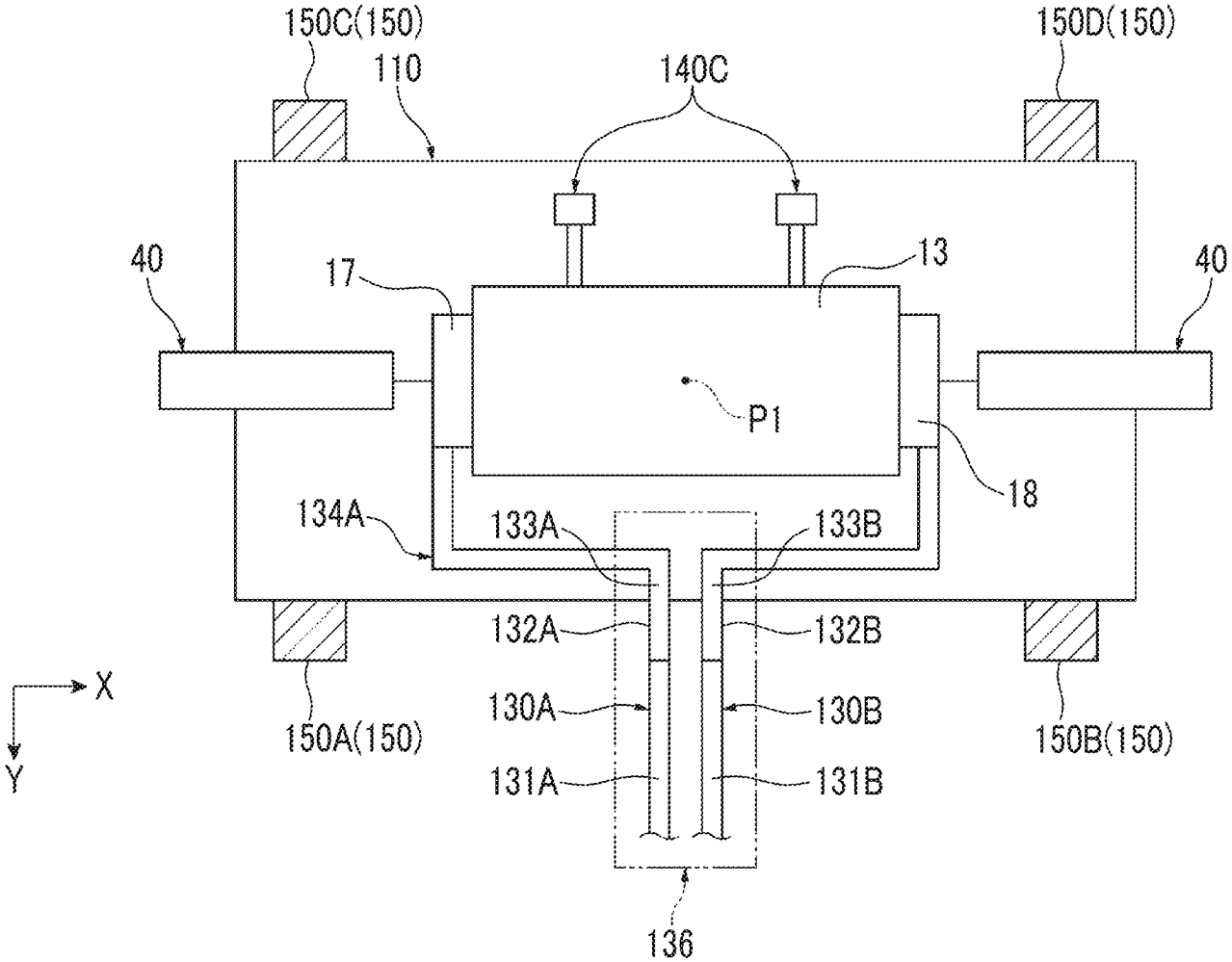
FIG. 4 is a view of a structure in the vicinity of the die as seen from above.
Figure 5:
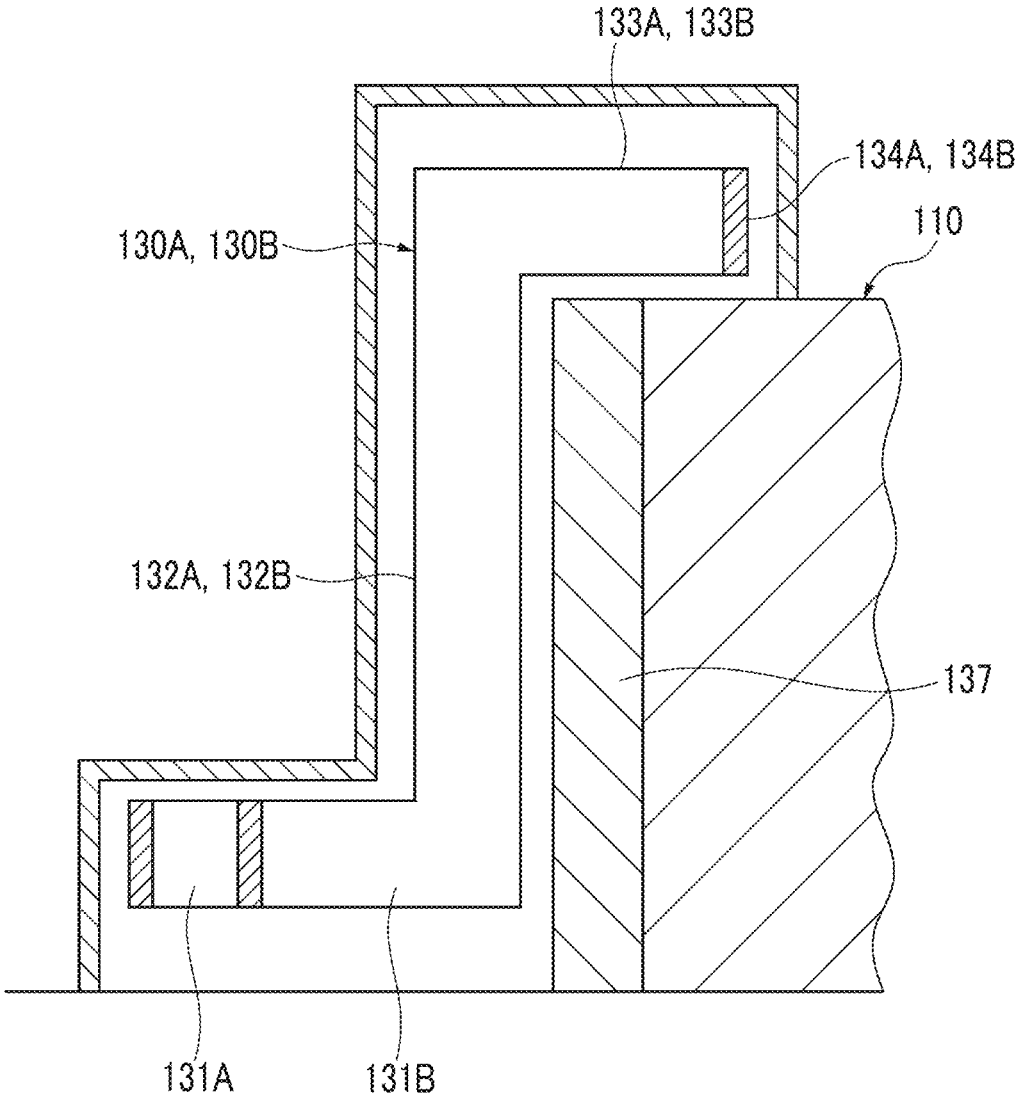
FIG. 5 is a view of busbars as seen from a positive side in an X-axis direction.

First, with reference to FIGS. 4 and 5, busbars 130A and 130B constituting the power supply line 52 for supplying power to the electrodes 17 and 18 will be described. FIG. 4 is a view of a structure in the vicinity of the die 13 as seen from above. FIG. 5 is a view of the busbars 130A and 130B as seen from the positive side in the X-axis direction. Through the busbar 130A, power is supplied to the electrode 17. Through the busbar 130B, power is supplied to the electrode 18. A pair of busbars 130A and 130B is disposed on a positive side (one side) of the die 13 in the Y-axis direction which is orthogonal to the X-axis direction in which the pair of electrodes 17 and 18 is disposed such that the electrodes 17 and 18 face each other and the vertical direction. Therefore, a region that is on a negative side in the Y-axis direction with respect to the die 13 becomes a region where the influence of magnetic fields of the busbars 130A and 130B is small due to the die 13. With devices such as various sensors or cylinders disposed on the region, it is possible to reduce the influence of the magnetic fields on the devices.

Extending portions 131A and 131B of the busbars 130A and 130B extend toward the lower base portion 110 in a direction from the positive side to the negative side in the Y-axis direction at a vertical position on a lower end side of the lower base portion 110. Extending portions 132A and 132B of the busbars 130A and 130B extend upward along a side surface of the lower base portion 110 that is on the positive side in the Y-axis direction in a direction from the lower end side of the lower base portion 110 to an upper end side thereof (particularly, refer to FIG. 5). Extending portions 133A and 133B of the busbars 130A and 130B extend up to positions above the lower base portion 110 in a direction from upper ends of the extending portions 132A and 132B to the negative side in the Y-axis direction. The extending portions 131A, 131B, 132A, 132B, 133A, and 133B extend in a state of being parallel with each other. Therefore, at the corresponding positions, the magnetic fields of the busbars 130A and 130B can cancel each other. At a position above the lower base portion 110, a branch portion 134A of the busbar 130A branches off from an end portion of the extending portion 133A, extends to a negative side in the X-axis direction, and bends to the negative side in the Y-axis direction to be connected to the electrode 17. At a position above the lower base portion 110, a branch portion 134B of the busbar 130B branches off from an end portion of the extending portion 133B, extends to the positive side in the X-axis direction, and bends to the negative side in the Y-axis direction to be connected to the electrode 18.

The extending portions 131A, 131B, 132A, 132B, 133A, and 133B of the busbars 130A and 130B are covered with a cover 136 for suppressing magnetic field leakage. In addition, on a side surface of the lower base portion 110, a bracket 137 for blocking a magnetic field and fixing the busbars 130A and 130B is provided at a position facing the extending portions 132A and 132B of the busbars 130A and 130B (refer to FIG. 5). The bracket 137 suppresses leakage of a magnetic field into the lower base portion 110. The material of the cover 136 and the bracket 137 is electromagnetic soft iron, silicon steel, permalloy, amorphous, or the like which can block a magnetic field.

In the forming device 10, various sensors are provided at each part. In the present embodiment, a sensor is disposed at a position where the sensor is less likely to be influenced by a magnetic field. Specifically, as shown in FIG. 2, the forming device 10 includes a sensor 140A disposed inside the upper base portion 120. The sensor 140A is a linear sensor for detecting the position of the shaft portion 82A. The sensor 140A is provided with respect to the cylinder portion 83A and the shaft portion 82A inside the upper base portion 120. A rod portion 140Aa of the sensor 140A is disposed in the cylinder portion 83A and is connected to the shaft portion 82A. A detection unit 140Ab of the sensor 140A is disposed at an upper end portion of the cylinder portion 83A.

The forming device 10 includes a sensor 140B disposed inside the lower base portion 110. The sensor 140B is a linear sensor for detecting the position of the shaft portion 82B. The sensor 140B is provided with respect to the cylinder portion 83B and the shaft portion 82B inside the lower base portion 110. A rod portion 140Ba of the sensor 140B is disposed in the cylinder portion 83B and is connected to the shaft portion 82B. A detection unit 140Bb of the sensor 140B is disposed at a lower end portion of the cylinder portion 83B.

As shown in FIG. 4, the forming device 10 includes sensors 140C on a region that is closer to the negative side in the Y-axis direction than the die 13. The region is a region opposite a region where the busbars 130A and 130B are disposed, with the die 13 interposed therebetween. Therefore, the sensors 140C are less likely to be influenced by magnetic fields from the busbars 130A and 130B. The sensors 140C are, for example, thermometers (a radiation thermometer) measuring the temperature of a die or the metal pipe material 14, measuring instruments (a position sensor, a contact switch, or the like) measuring the expansion length of the metal pipe material 14, Gauss meters measuring a magnetic field, or the like.

Note that, the forming device 10 may include a plurality of sensors different from each other in type or detection method, with respect to the same measurement target. In a case where the sensors show significantly different values although measurement is performed with respect to the same measurement target, there is a possibility of malfunction of any of the sensors caused by the influence of a magnetic field. Therefore, the controller 70 acquires the results of detection from the plurality of sensors and compares the results with each other. In a case where the results of detection from the sensors are significantly different from each other, the controller 70 detects that there is malfunction. For example, a position detection sensor such as an encoder, of which the measurement method is different from that of a linear sensor, may be provided with respect to the cylinder portion 83A and the shaft portion 82A in addition to the sensor 140A.

As shown in FIGS. 1 and 4, the forming device 10 includes the pillar portions 150 as members for absorbing a magnetic flux generated near the die 13. The material of the pillar portions 150 is steel or the like. Note that, the material of the lower base portion 110 and the upper base portion 120 is steel or the like and may be the same as or different from the material of the pillar portions 150. As shown in FIG. 1, the pillar portions 150 are provided to stand between the lower base portion 110 and the upper base portion 120 to be disposed at positions corresponding to at least the lower die 11, the upper die 12, and the slide 81A in the vertical direction. As shown in FIG. 4, four pillar portions 150A, 150B, 150C, and 150D are disposed near four corner portions of the lower base portion 110. The pillar portion 150A is disposed at a corner portion that is on the positive side in the Y-axis direction and the negative side in the X-axis direction. The pillar portion 150B is disposed at a corner portion that is on the positive side in the Y-axis direction and the positive side in the X-axis direction. The pillar portion 150C is disposed at a corner portion that is on the negative side in the Y-axis direction and the negative side in the X-axis direction. The pillar portion 150D is disposed at a corner portion that is on the negative side in the Y-axis direction and the positive side in the X-axis direction.

The pillar portions 150A and 150B are disposed at positions separated in a direction toward the positive side in the Y-axis direction from an end portion of the die 13 on the positive side in the Y-axis direction. The pillar portions 150C and 150D are disposed at positions separated in a direction toward the negative side in the Y-axis direction from an end portion of the die 13 on the negative side in the Y-axis direction. A distance by which the pillar portions 150A and 150B are separated from the end portion of the die 13 on the positive side in the Y-axis direction and a distance by which the pillar portions 150C and 150D are separated from the end portion of the die 13 on the negative side in the Y-axis direction may be set to about 100 mm to 3000 mm. Accordingly, the pillar portions 150A, 150B, 150C, and 150D can favorably absorb a magnetic flux generated near the die 13. The pillar portions 150A and 150C are disposed at positions separated in a direction toward the negative side in the X-axis direction from an end portion of the die 13 on the negative side in the X-axis direction. The pillar portions 150B and 150D are disposed at positions separated in a direction toward the positive side in the X-axis direction from an end portion of the die 13 on the positive side in the X-axis direction. A distance by which the pillar portions 150A and 150C are separated from the end portion of the die 13 on the negative side in the X-axis direction and a distance by which the pillar portions 150B and 150D are separated from the end portion of the die 13 on the positive side in the X-axis direction may be set to about 100 mm to 3000 mm. Accordingly, the pillar portions 150A, 150B, 150C, and 150D can favorably absorb a magnetic flux generated near the die 13.

Figure 6:
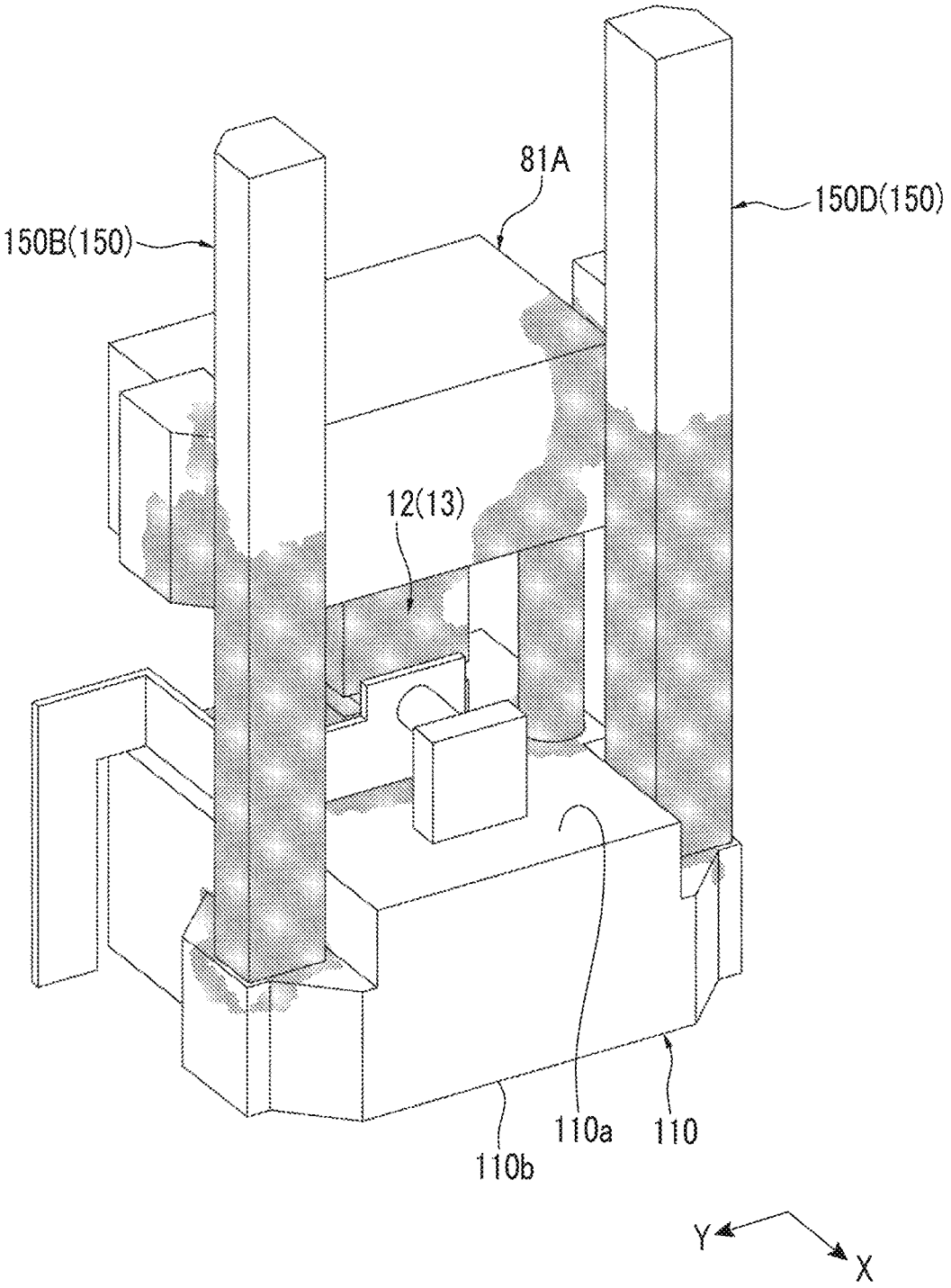
FIG. 6 is a model view showing a magnetic flux density intensity near pillar portions.

As described above, the pillar portions 150 absorb a magnetic flux generated near the die 13. Therefore, at the time of electrical heating performed by the electrical heating unit 50, magnetic flux densities inside the pillar portions 150 are higher than at least one of a magnetic flux density at a center P1 (refer to FIG. 1) of the lower surface 110*b* of the lower base portion 110 and a magnetic flux density at a center P2 (refer to FIG. 1) of the upper surface 120*b* of the upper base portion 120. The centers P1 and P2 are central positions of the surfaces 110*b* and 120*b* in the Y-axis direction and the X-axis direction. In addition, a configuration in which the magnetic flux densities inside the pillar portions 150 are higher by 50% or more than the magnetic flux densities at the center P1 of the lower surface 110*b* of the lower base portion 110 and the center P2 of the upper surface 120*b* of the upper base portion 120 is preferable. With such a configuration, the pillar portions 150 can sufficiently absorb a magnetic flux near the die 13. FIG. 6 is a model view showing a magnetic flux density intensity near the pillar portions 150A and 150C. In FIG. 6, a portion given a gray scale is a portion where a magnetic flux density is equal to or greater than 0.1 T (tesla). As shown in FIG. 6, magnetic flux densities at regions on the pillar portions 150 that are between the upper surface 110*a* of the lower base portion 110 and a lower surface of the slide 81A are equal to or greater than 0.1 T.

In addition, the magnetic flux densities inside the pillar portions 150 at the time of electrical heating are higher than an average value of magnetic flux densities at four side surfaces of the lower base portion 110 and an average value of magnetic flux densities at four side surfaces of the upper base portion 120. The magnetic flux densities inside the pillar portions 150 are higher than magnetic flux densities near outer peripheral portions of the upper surface 110*a* of the lower base portion 110 and the lower surface 120*a* of the upper base portion 120 that are separated from the die 13 in a direction toward an outer peripheral side.

Here, the "magnetic flux density inside the pillar portion 150" is an average value of magnetic flux densities at a section of the pillar portion 150 at a reference position when the reference position on the pillar portion 150 is set in the vertical direction. Alternatively, a magnetic flux density measured at any of surfaces of the pillar portion 150 may be used as the magnetic flux density at the pillar portion 150. The reference position in the vertical direction may be set in any manner and for example, a central position in the vertical direction between the upper surface 110*a* of the lower base portion 110 and the lower surface of the slide 81A may be set as the reference position. Alternatively, a central position in the vertical direction between a lower surface of the lower die 11 and an upper surface of the upper die 12 in a state where the die 13 is closed may be set as the reference position. In addition, as the reference position, a position on any of the surfaces of the pillar portion 150 may be set.

The operations and effects of the forming device 10 according to the present embodiment will be described.

According to the forming device 10, the pillar portions 150 are disposed between the lower base portion 110 provided below the lower die 11 and the upper base portion 120 provided above the upper die 12. In addition, at the time of electrical heating performed by the electrical heating unit 50, the magnetic flux densities inside the pillar portions 150 are higher than at least one of the magnetic flux density at the center P1 of the lower surface 110*b* of the lower base portion 110 and the magnetic flux density at the center P2 of the upper surface 120*b* of the upper base portion 120. The magnetic flux densities being high at the time of electrical heating means that the pillar portions 150 are configured to absorb a nearby magnetic flux near the die 13. As described above, the pillar portions 150 absorb a magnetic flux generated near the die 13 and thus it is possible to reduce a magnetic flux toward another sensor by an amount corresponding to the absorption. Accordingly, it is possible to reduce the influence of a magnetic field on a sensor or the like near the die 13.

The forming device 10 further includes the sensors 140A and 140B disposed inside the upper base portion 120 and the lower base portion 110. The insides of the upper base portion 120 and the lower base portion 110 are positions that are less likely to be influenced by a magnetic field. Therefore, with the sensors 140A and 140B disposed at the positions, it is possible to reduce the influence of a magnetic field with respect to the sensors 140A and 140B.

In the forming device 10, the electrical heating unit 50 may include the pair of electrodes 17 and 18 which comes into contact with the metal pipe material 14 at the time of electrical heating and the pair of busbars 130A and 130B which transmits power to the pair of electrodes 17 and 18 and the pair of busbars 130A and 130B may be disposed on one side of the die 13 in the Y-axis direction which is orthogonal to the X-axis direction in which the pair of electrodes 17 and 18 is disposed such that the electrodes 17 and 18 face each other and the vertical direction. A large current flows at the pair of the busbars 130A and 130B at the time of electrical heating. With both of the busbars 130A and 130B disposed on the one side of the die 13 in the Y-axis direction, a region on the other side of the die 13 becomes a region where a magnetic field generated from the busbars 130A and 130B is blocked by the die 13. Therefore, with the sensor or the like disposed on the region, it is possible to reduce the influence of a magnetic field.

The present invention is not limited to the above-described embodiment.

For example, the shapes or positions of the lower base portion, the upper base portion, and the pillar portions may be appropriately changed without departing from the spirit of the present invention. In addition, the number of pillar portions is not particularly limited and five or more pillar portions may be provided. In addition, the shapes or positions of the die, the electrical heating unit, the gas supply unit, and other components may also be appropriately changed.

It should be understood that the invention is not limited to the above-described embodiment, but may be modified into various forms on the basis of the spirit of the invention. Additionally, the modifications are included in the scope of the invention.

What is claimed is:

1. A forming device comprising:

a die that is comprised of an upper die and a lower die;

an upper base portion that is comprised of:

a lower surface of the upper base portion between the upper die and an upper surface of the upper base portion;

a lower base portion that is comprised of:

an upper surface of the lower base portion between the lower die and a lower surface of the lower base portion;

an electrical heating unit that is configured to supply, to a metal pipe material when the metal pipe material is between the upper die and the lower die, power that heats the metal pipe material; and a pillar portion that is configured to absorb, when the electrical heating unit supplies the power to the metal pipe material, a magnetic flux in a manner that causes a magnetic flux density inside the pillar portion to become higher than a magnetic flux density from the group consisting of:

a magnetic flux density at a center of the lower surface of the lower base portion, and a magnetic flux density at a center of the upper surface of the upper base portion.

2. The forming device according to claim 1, further comprising:

an additional pillar portion that is configured to absorb, when the electrical heating unit supplies the power to the metal pipe material, the magnetic flux, wherein the die is between the pillar portion and the additional pillar portion.

3. The forming device according to claim 1, wherein the pillar portion is between the lower surface of the upper base portion and the upper surface of the lower base portion.

4. The forming device according to claim 1, wherein the pillar portion extends from the lower surface of the upper base portion to the upper surface of the lower base portion.

5. The forming device according to claim 1, further comprising:

a sensor inside at least one of the upper base portion and the lower base portion.

6. The forming device according to claim 5, wherein the sensor is configured to measure a parameter from the group consisting of a temperature of the die or the metal pipe material, a expansion length of the metal pipe material, and a magnetic field.

7. The forming device according to claim 1, wherein the electrical heating unit comprises a pair of electrodes that is configured to come into contact with the metal pipe material when the electrical heating unit supplies the power to the metal pipe material.

8. The forming device according to claim 7, wherein the electrical heating unit comprises a pair of power supply lines that is configured to transmit the power to the pair of electrodes.

9. The forming device according to claim 8, wherein the die is between the pair of power supply lines.

10. The forming device according to claim 8, further comprising:

a sensor disposed on a region that is opposite to a region where the pair of power supply lines is disposed.

11. The forming device according to claim 8, wherein the pair of power supply lines is disposed on one side of the die in a second direction which is orthogonal to a first direction in which the pair of electrodes is disposed such that the electrodes face each other in the first direction.

12. The forming device according to claim 8, wherein the pair of power supply lines comprises extending portions that extend upward from a lower end side of the lower base portion to an upper end side of the lower base portion.

13. The forming device according to claim 12, wherein the extending portions of the pair of power supply lines extend in a state of being parallel with each other.

14. The forming device according to claim 12, wherein the extending portions of the pair of power supply lines are covered with a cover for suppressing magnetic field leakage.

15. The forming device according to claim 14, wherein a material of the cover is from the group consisting of electromagnetic soft iron, silicon steel, permalloy, and amorphous.

16. The forming device according to claim 14, further comprising:

a bracket configured to block a magnetic field, the bracket fixes the pair of power supply lines at a position facing the extending portions of the pair of power supply lines, on a side surface of the lower base portion.

17. The forming device according to claim 16, wherein a material of the bracket is one selected from the group consisting of electromagnetic soft iron, silicon steel, permalloy, and amorphous.

* * * * *